US005782054A

United States Patent [19]

Varoglu et al.

[11] Patent Number: 5,782,054

[45] Date of Patent: Jul. 21, 1998

[54] WOOD WALL STRUCTURE

[75] Inventors: Erol Varoglu, Vancouver; Siegfried Fritz Stiemer, Surrey, both of Canada

[73] Assignee: Forintek Canada Corp., Vancouver, Canada

[21] Appl. No.: 784,977

[22] Filed: Jan. 17, 1997

[51] Int. Cl.[6] ..... E04B 2/70

[52] U.S. Cl. ..... 52/780; 52/455; 52/481.1; 52/764; 52/801.1; 52/801.11; 52/802.1; 52/712

[58] Field of Search ..... 52/780, 481.1, 52/455, 764, 801.1, 801.11, 802.1, 712

[56] References Cited

U.S. PATENT DOCUMENTS

| | | | |
|---|---|---|---|
| 453,047 | 5/1891 | Hanrahan . | |
| 878,627 | 2/1908 | Hecker | 52/801.1 X |
| 927,205 | 7/1909 | Allen | 52/780 X |
| 1,096,773 | 5/1914 | Vernon . | |
| 1,607,542 | 11/1926 | Landaw | 52/801.11 X |
| 2,264,377 | 12/1941 | Hoffman . | |
| 2,375,910 | 5/1945 | Forward . | |
| 2,397,345 | 3/1946 | Gilleland | 52/780 X |
| 2,787,812 | 4/1957 | Long | 52/780 X |
| 2,922,201 | 1/1960 | Baker . | |
| 3,305,993 | 2/1967 | Nelsson . | |
| 3,407,555 | 10/1968 | Pugh | 52/780 X |
| 3,423,894 | 1/1969 | Richardson | 52/780 X |
| 3,999,343 | 12/1976 | Roberts . | |
| 4,628,651 | 12/1986 | Morettin . | |
| 5,095,671 | 3/1992 | Mitani | 52/455 X |

*Primary Examiner*—Christopher Kent
*Attorney, Agent, or Firm*—Christie, Parker & Hale, LLP

[57] ABSTRACT

A wood wall structure has standard components arranged in such a way that strength and ductile capacity exceeds those in current standard wall arrangements. The structure has a top plate and a bottom plate that are substantially the same, each plate having a groove along the center face, a central sheath is positioned between the top and bottom plates fitting into each groove. Pairs of vertical framing elements extend between the top and bottom plates with the central sheath sandwiched therebetween and attachments between the pairs of framing elements retain the central sheath in position.

18 Claims, 4 Drawing Sheets

WOOD WALL STRUCTURE

TECHNICAL FIELD

The present invention relates to wood frame buildings and more specifically to a wood wall structure having improved strength properties over standard structures.

BACKGROUND ART

Wood frame houses have a reputation of performing well during severe earthquakes and hurricanes. The standard wood wall frame consists of vertical and horizontal elements generally with a structural sheathing on one side. The vertical and horizontal elements, generally referred to as studs and plates respectively, are made of dimensioned lumber of nominal 2"×4" or wider and the structural sheathing is generally plywood or oriented strandboard (OSB) panels. Gypsum boards may be used as an inside layer, but these can only provide a limited contribution to the strength of the wall structure.

Wood frame construction has evolved to include multi-family residences of three or four storeys, however, in recent years damage to multi-storey modern buildings from hurricanes and earthquakes has resulted in limiting the use of wood in shear walls in regions susceptible to severe earthquakes or strong winds. Thus, there is a demand for stronger shear walls made from wood.

SUMMARY OF THE INVENTION

The present invention provides a shear wall made of wood with standard components arranged in such a way that the shear, bending, compression and ductile capacity of the system exceeds that in current standard wall arrangements. The design helps to prevent or reduce the damage that a multi-storey modern building in wood frame construction might experience during an earthquake or from strong winds. It permits wood frame buildings to be built to greater heights than the current three or four storeys and accommodates prefabrication which in some instances is desirable to achieve quality control.

The wood wall structure of the present invention has a top plate and a bottom plate, preferably nominal 2"×4" lumber, thus having substantially the same width. Each plate has a groove extending longitudinally along the center of one wide face, and between these two plates is a central sheath, preferably plywood or OSB panels, that fit into the grooves in the top and bottom plates, thus the sheath is retained by the grooves and unlike existing wall structures does not have to be attached to either the outside or the inside of the wood frame. Pairs of vertical framing elements, namely studs, preferably nominal 2"×4" lumber, although other sizes may be used, extend between the top plate and the bottom plate sandwiching the central sheath therebetween. In effect the studs are turned through 90° from the standard wood frame construction, thus the distance across the two studs and the sheath therebetween is a nominal four inches which is the same as the width of the top and bottom plates. This design permits the sheathing panels to be fastened to the wide faces of the studs instead of the narrower faces of the nominal two inch width and this increases the load capacity of the wall structure by providing more edge distance for fasteners on studs as well as on edges of the central sheathing. Also the head of the nails are kept away from the surface of the sheathing panels so that nail withdrawal from the panels is physically prevented. Nails fastening the sheathing panels to the studs work in double shear, thus providing increased lateral load carrying capacity for the wall structure in comparison to the nails working in single shear in standard shear wall structure.

The wall structure therefore has a central sheath which has edges fitting either in grooves and/or being sandwiched between wide faces of studs and joined together by nails or screws that pass through two studs and both sides of the sheathing panels, thus increasing the shearing capacity of the wall structure without increasing the width of the wall.

The present invention provides a wood wall structure comprising: a top plate and a bottom plate, both having substantially the same width, each plate having a groove extending longitudinally along the center of a face of the top plate and the bottom plate; a central sheath positioned between the top plate and the bottom plate fitting into each groove; pairs of vertical framing elements extending between the top plate and the bottom plate with the central sheath sandwiched therebetween, the pairs of framing elements positioned at both ends of the wall structure and spaced along the length of the wall structure, the pairs of framing elements with the central sheath therebetween having a width substantially the same as the width of the top plate and the bottom plate, and attachments between the pairs of framing elements retaining the central sheath therebetween.

BRIEF DESCRIPTION OF THE DRAWINGS

In drawings which illustrate embodiments of the present invention.

DETAILED DESCRIPTION OF THE INVENTION

Figure 1:
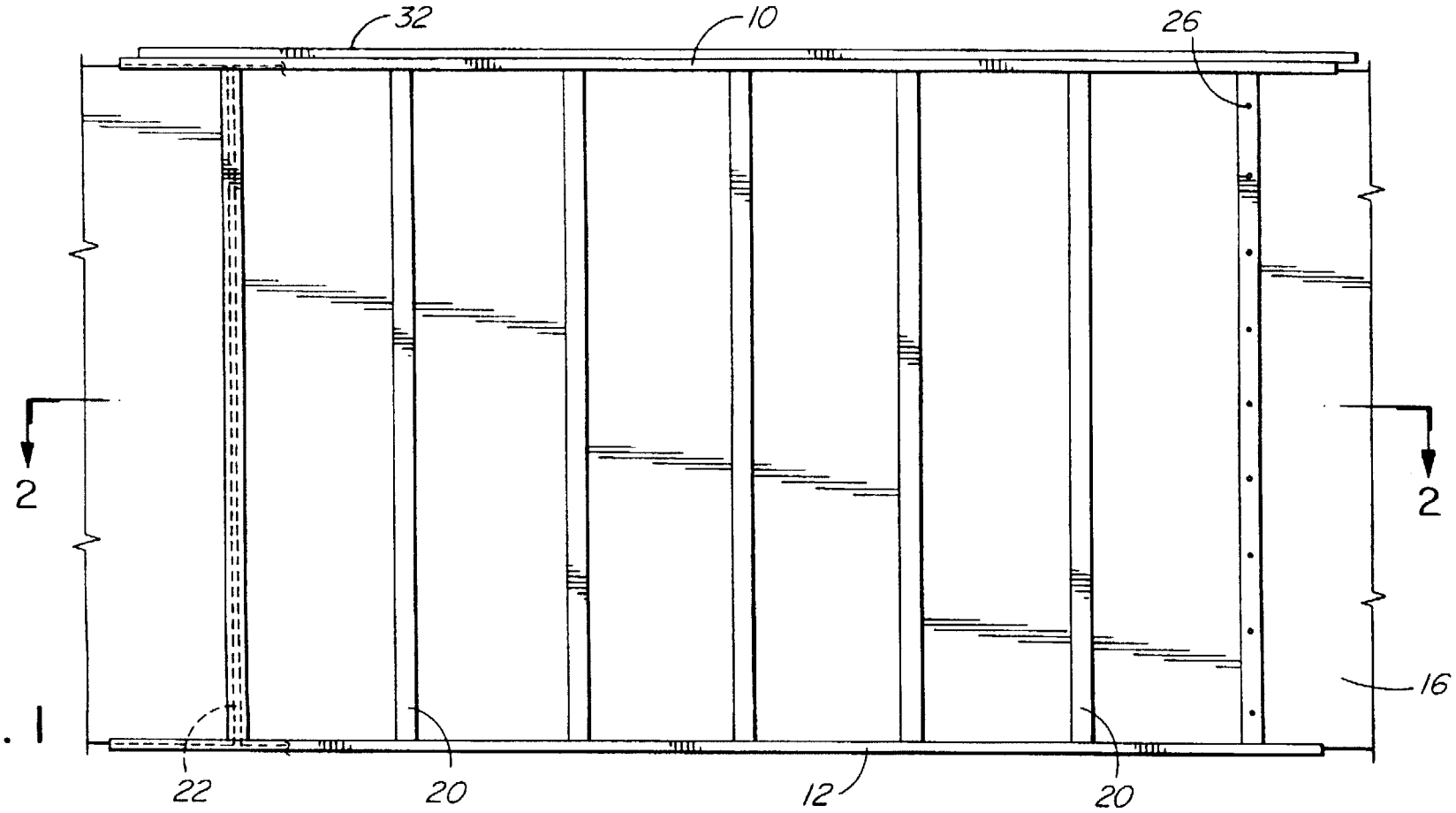
FIG. 1 is an elevational view showing a wood wall structure according to one embodiment of the present invention.
Figure 2:
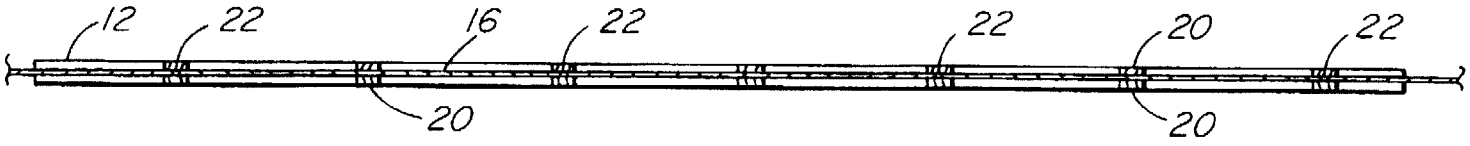
FIG. 2 is a sectional view taken at line 2—2 of FIG. 1.

FIGS. 1 and 2 illustrate a wood wall structure according to one embodiment of the present invention which comprises a top plate 10 and a bottom plate 12 made of nominal 2"×4" lumber with the 4" side representing the thickness of the wall structure. Both plates 10 and 12 have a longitudinal groove 14 on the inside surface in the approximate center of each plate. Details of the groove 14 may be seen in FIG. 3. Into this groove 14 fits a central sheath panel 16, the grooves 14 are approximately ½" wide and ½" deep. The central sheath panel 16 are approximately ½" thick and is therefore held between the two plates 10 and 12. In general panels 16 have a loose fit in the grooves 14 for ease of installation and also to ensure that the panels 16 do not bind in the grooves 14.

The central sheath 16 is preferably made from 8'×4' panels of plywood or oriented strandboard with a thickness of ½". FIGS. 1 and 2 show the panels 16 mounted vertically, thus the height of the wall structure is approximately 8'. The panels may be cut to the desired height of the wall structure. Pairs of vertical framing elements 20 which are studs made of nominal 2"×4" lumber are positioned one on each side of the central sheath panel 16 sandwiching the panel in between the studs 20. The studs 20 are placed with the wider faces along the sheathing panels 16 rather than the common practice of placing the studs with the wide side representing the thickness of a wall structure. Pairs of studs 20 are spaced substantially evenly along the wall structure. Edges of adjacent panels 16 are positioned so that they come between a pair of studs 20 with a small space 22 between panel edges as shown in FIG. 2. As the panels are 4' wide, the pairs of studs 20 are generally spaced either 24" or 16" apart.

Nails 26 pass through one stud 20 of a pair, through the central sheath panel 16 and into the second stud 20. Thus the nails 26 work in double shear to provide increased lateral load carrying capacity for the wall. The studs 20 being nominal 2"×4" lumber have the wider face along the wood wall structure which increases the lateral load capacity of the wall by providing more edge distance for fasteners on the studs 20 and edges of the sheath panels 16.

Figure 3:
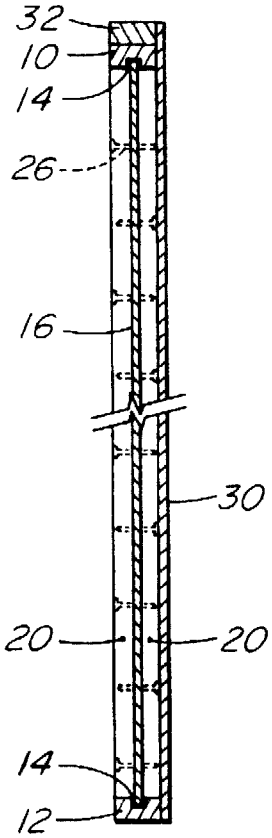
FIG. 3 is a vertical sectional view showing another embodiment of a wood wall structure according to the present invention.

FIG. 3 shows a wall structure similar to that shown in FIGS. 1 and 2 but has an outside sheath panel 30 attached to the outside of the wall structure. The attachment is by nails or screws to the outside surfaces of the studs 20 and the plates 10 and 12. The outside sheath panel 30 may be a minimum of ¼" thick plywood or OSB. The outside sheath 30 increases the shear strength of the wall structure.

A nailing plate 32 is shown attached above the top plate 10. The nailing plate 32 is provided as a standard item in most wall structures for connection to the upper floor or roof structure.

FIG. 3 illustrates the central sheath panels 16 and the outside sheath panels 30, both being vertical panels, preferably 8'×4'. The edges of adjoining central panels 16 do not overlap with the edges of adjoining side panels 30. The joint of the central sheath panels 16 occurs in between one pair of studs 20 and the joint of the outside sheath panels 30 occurs in between an adjacent or different pair of studs 20.

Figure 4:
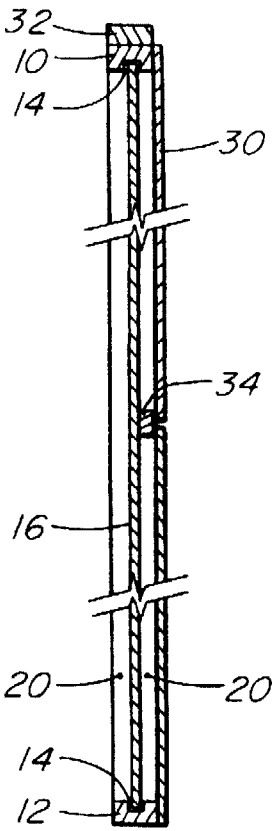
FIG. 4 is a vertical sectional view showing a further embodiment of a wood wall structure according to the present invention.

FIG. 4 illustrates a wall structure similar to that shown in FIG. 3 except the outside sheath panels 30 are arranged horizontally rather than vertically. Thus, nailing strips 34 at the mid-height of the structure are positioned between studs 20 on the outside so that the outside sheath panels 30 can be affixed thereto.

Figure 5:
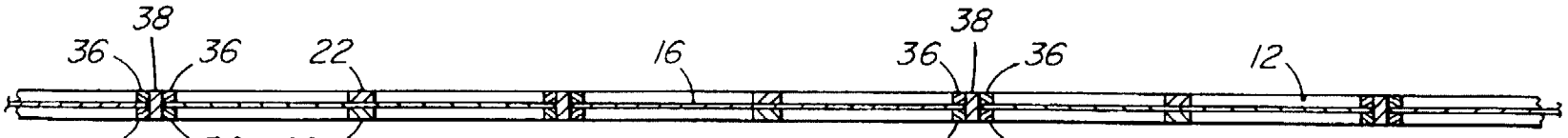
FIG. 5 is a horizontal sectional view showing yet another embodiment of a wood wall structure according to the present invention.

FIG. 5 illustrates a wall structure similar to that shown in FIG. 2 except that the vertical edges of the central sheath panels 16 are contained within a pair of nominal 2"×2" lumber studs 36, thus forming in effect a groove for holding the vertical edges of the panels 16. In between these vertical edges is an intermediate nominal 2"×4" lumber stud 38 to provide additional strength. Thus, the wall construction is divided into 4' panels with the intermediate stud 38 therebetween. Whereas the nominal 2"×2" lumber studs 36 are shown in FIG. 5, it will be apparent that these could be other nominal lumber sizes such as 2"×3"s or 2"×4"s. Furthermore, while 2"×4"s have been shown in the drawings throughout, it is always preferred that the top plate 10 and bottom plate 12 are always 2"×4"s but the other studs may be selected from nominal lumber sizes such as but not limited to 2"×2"s, 2"×4"s, 2"×6"s, or 2"×8"s. In other countries where nominal lumber sizes are different and not in inches, then metric dimensioned framing elements may be used. The key being that the width of the top and bottom plates 10,12 is substantially the same as the width across the pair of studs or structural elements 20 with the central sheath panel 16 therebetween.

Figure 6:
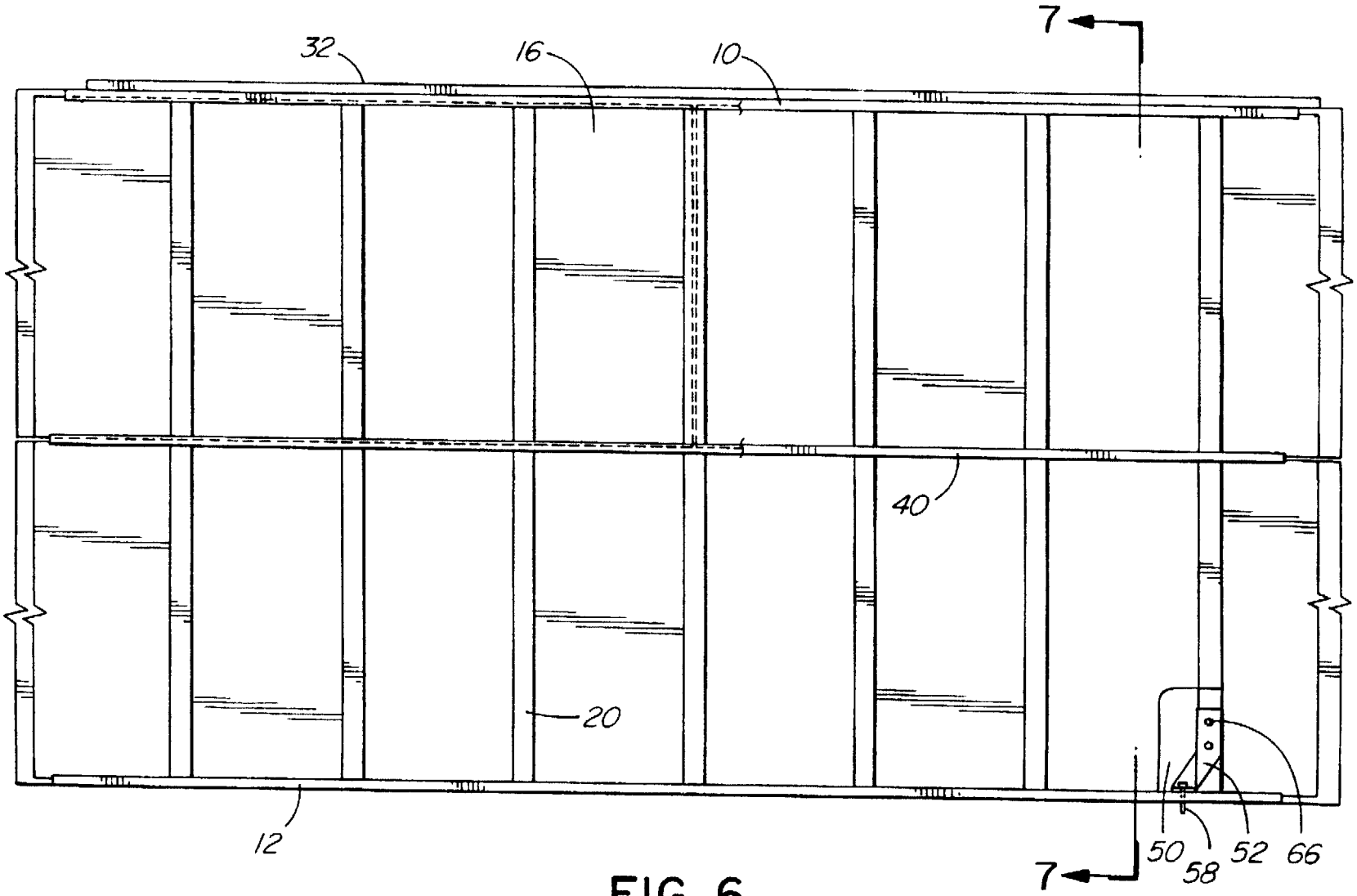
FIG. 6 is an elevational view showing a wood wall structure with horizontal central sheath panels and horizontal outside sheath panels.
Figure 7:
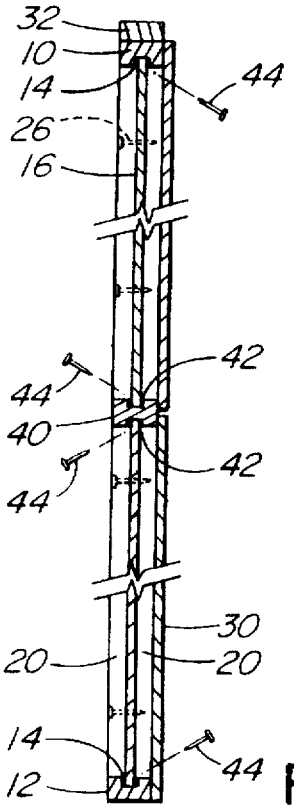
FIG. 7 is a sectional view taken at line 7—7 of FIG. 6.

A different arrangement of a wood wall structure is shown in FIGS. 6 and 7. In this embodiment the central sheath panels 16 are shown extending horizontally rather than vertically and have a central frame element 40 which is a nominal 2"×4" lumber stud and has central grooves 42 on each side as illustrated in FIG. 7. The top edges of the lower panels 16 and the lower edges of the top panels 16 both fit into the grooves 42, thus the central panels 16 are contained around all the edges. In another embodiment the central framing element 40 is replaced by two 2"×4"s or 2"×3"s with a space therebetween to act as a groove for the top edge of the bottom panel 16 and the bottom edge of the top panel 16.

As shown in FIG. 7, horizontal outside sheath panels 30 are also supplied. These panels join at the center framing element 40 and are nailed thereto, as well as being nailed to the top plate 10, bottom plate 12, and framing elements 20.

In another embodiment vertical outside sheath panels 30 are supplied. While not shown in the drawings, these vertical outside sheath panels 30 join at framing elements 20 and are nailed to the top plate 10, bottom plate 12 and the framing elements 20.

In another embodiment, as shown in FIG. 7, nails 44 are provided which are directed at an angle to act as toe-in nails for the edge of the central sheath panel 16 attaching through the grooves 14 of the top plate 10 and bottom plate 12 and also attaching through the grooves 42 of the central framing element 40. Whereas nails have been described herein, screws may equally well be used or other similar type of attachment devices.

The wood wall structures may be used in new wood frame construction or retrofitting of existing wood frame buildings in order to improve their earthquake or wind resistance. Furthermore, the structure may be used in the new type of post and beam construction as well as retrofitting post and beam construction for improved resistance. In each case the wall structure provides additional strength for earthquake and wind resistance. In some cases it may be preferable to strengthen the lower storeys of a building by replacing certain wall sections in existing buildings with the wall structure of the present invention. The wall structures can be manufactured in an assembly plant or made on site. The advantage of assembly plant construction is that jigs can be used which generally produce structures with better tolerances.

Figure 8:
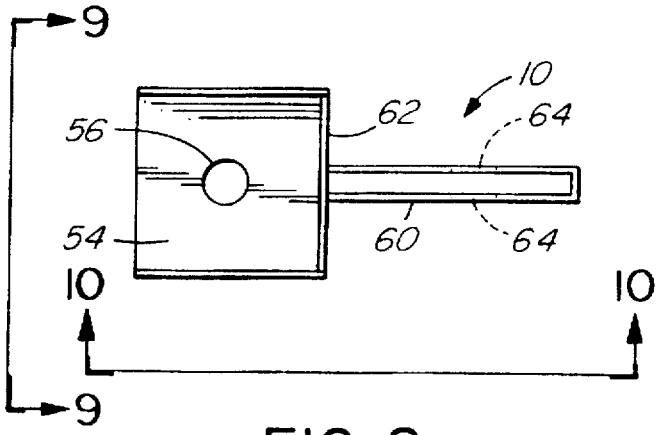
FIG. 8 is a plan view showing a hold down detail according to one embodiment of the present invention.
Figure 9:
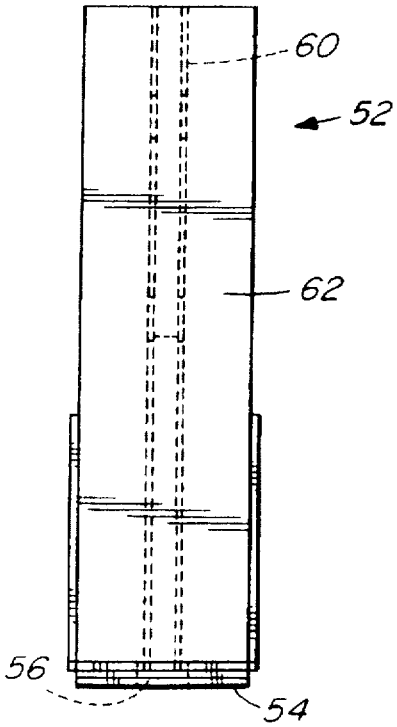
FIG. 9 is an end view taken at line 9—9 of FIG. 8.
Figure 10:
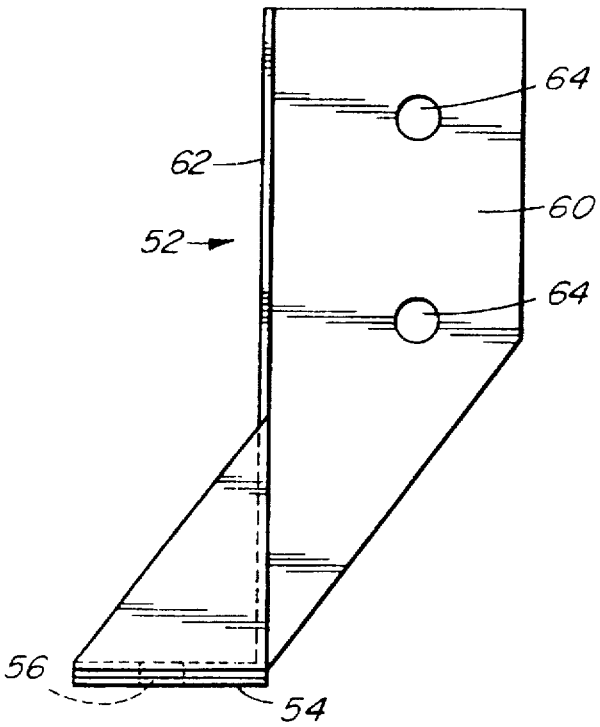
FIG. 10 is a side view taken at line 10—10 of FIG. 8.

Hold down cutouts 50 are shown in FIG. 6 in central sheath panels 16 for a hold down 52 as shown in FIGS. 8, 9 and 10. The hold down bracket 52 has a bottom member 54 with a hole 56 for a hold down bolt 58 as shown in FIG. 6. A vertical wall 60 extends up between a pair of framing elements 20, a front panel 62 positions the apparatus against the framing elements 20, and holes 64 in the wall 60 permit bolts 66 to hold the apparatus in place. Hold downs 52 may be positioned to hold through the top plates 10 or bottom plates 12.

Rigid insulation may be placed in the space between the studs 20. In the case of nominal 2"×4" lumber, 1½" rigid insulation may be used on both sides of the central sheath panels 16. If additional rigid insulation is required it may be placed on the outside of the wall structure.

Grooves may be provided on the face of studs, and holes may be made in the central sheath panels 16 for electrical wiring installation either on site or in the case of a prefabricated wall may be made during fabrication.

Various changes may be made to the embodiments shown herein without departing from the scope of the present invention which is limited only by the following claims.

We claim:

1. A wood wall structure comprising:

a top plate and a bottom plate, each having a width across a face, each face extending longitudinally along the wood wall structure, both having substantially the same width, each plate having its face in opposed relation to the other said face and a central groove extending longitudinally along such face;

a central sheath positioned between the top plate and the bottom plate fitting into the central groove in each plate;

pairs of vertical framing elements extending between the top plate and the bottom plate with the central sheath sandwiched therebetween, the pairs of framing elements being positioned at both ends of the wall structure and spaced longitudinally along the wall structure, the pairs of framing elements with the central sheath therebetween having a width substantially the same as the width of the top plate and the bottom plate, and attachments between the pairs of framing elements retaining the central sheath therebetween.

2. The wood wall structure according to claim 1 wherein the top plate and the bottom plate are made of nominal 2"×4" lumber and the central groove in each plate is in a nominal 4" wide face thereof, the central groove being approximately ½" wide and ½" deep.

3. The wood wall structure according to claim 2 wherein the central sheath is an approximately ½" thick panel and fits loosely in the central groove of the top plate and the bottom plate.

4. The wood wall structure according to claim 1 wherein the attachments are selected from the group consisting of nails and screws.

5. The wood wall structure according to claim 3 wherein the central sheath is toe-nailed in the groove of the top plate and the groove of the bottom plate.

6. The wood wall structure according to claim 1 wherein the vertical framing elements are selected from nominal lumber sizes of 2"×2", 2"×3", 2"×4", 2"×6", and 2"×8" and are positioned so that pairs of framing elements with the central sheath therebetween have a width substantially the same as the width of the top plate and the bottom plate.

7. The wood wall structure according to claim 1 wherein the central sheath is selected from a plywood panel and an oriented strandboard panel.

8. The wood wall structure according to claim 7 wherein the panels have a size of approximately 8'×4' and are positioned vertically side by side, and wherein a gap of approximately ⅛" remains between adjoining panel edges, the adjoining panel edges positioned between a pair of vertical framing elements.

9. The wood wall structure according to claim 1 including an outside sheath mounted outside the wall structure and attached to the top plate, bottom plate and an outside surface of the pairs of vertical framing elements.

10. The wood wall structure according to claim 9 wherein the outside sheath is formed of 8'×4' panels mounted vertically with adjoining panel edges of the outside sheath positioned at an outside framing element of each of a first pair of framing elements, a second pair of framing elements, parallel to the first pair of framing elements having adjoining panel edges of the central sheath positioned therein.

11. The wood wall structure according to claim 9 wherein the central sheath is formed of 8'×4' panels mounted vertically and the outside sheath is formed of 8'×4' panels mounted horizontally, and including a central nailing strip positioned centrally along the wood wall structure between the top plate and the bottom plate to which the panels of the outside sheath are attached.

12. The wood wall structure according to claim 1 wherein the central sheath is formed of 8'×4' panels mounted vertically with pairs of vertical framing elements at both ends of the panels and including an adjoining framing element positioned between vertical edges of panels of the central sheath.

13. The wood wall structure according to claim 12 including an outside sheath formed of 8'×4' panels, and wherein adjoining edges of the panels of the outside sheath are positioned at first pairs of vertical framing elements, and second pairs of framing elements parallel to the first pairs of framing elements having adjoining panel edges of the central sheath positioned therein.

14. The wood wall structure according to claim 1 wherein the central sheath is formed of 8'×4' panels mounted horizontally with central framing elements having grooves on opposing faces for horizontal edges of the central sheath panels to fit therein.

15. The wood wall structure according to claim 14 including an outside sheath formed of 8'×4' panels mounted horizontally and attached at adjoining horizontal edges to the central framing elements, adjoining vertical edges of the panels of the outside sheath and adjoining vertical edges of the panels of the central sheath being staggered.

16. The wood wall structure according to claim 14 including an outside sheath formed of 8'×4' panels mounted vertically, and with adjoining edges of the panels of the outside sheath positioned at first pairs of vertical framing elements, and with adjoining edges of the panels of the central sheath positioned at second pairs of vertical framing elements parallel to the first pairs of vertical framing elements.

17. The wood wall structure according to claim 1 wherein the thickness of the structure is nominally 4".

18. The wood wall structure according to claim 1 including a hold down bracket having a bottom member to rest on the top or bottom plate with a vertical wall section extending between a pair of vertical framing elements, the hold down bracket having a hole in the bottom member for a hold down wall, and further attachments connecting the vertical wall between the pair of vertical framing elements.

* * * * *